US011453463B1

(12) United States Patent
Steininger et al.

(10) Patent No.: US 11,453,463 B1
(45) Date of Patent: Sep. 27, 2022

(54) SPORT ANCHOR

(71) Applicants: Jeffrey Alan Steininger, St. Marys, OH (US); Duane Mattix, Plymouth, IN (US)

(72) Inventors: Jeffrey Alan Steininger, St. Marys, OH (US); Duane Mattix, Plymouth, IN (US)

(73) Assignee: SANDSHARK, INC., Plymouth, IN (US)

( * ) Notice: Subject to any disclaimer, the term of this patent is extended or adjusted under 35 U.S.C. 154(b) by 0 days.

(21) Appl. No.: 16/873,376

(22) Filed: Mar. 30, 2020

(51) Int. Cl.
*B63B 21/26* (2006.01)
*B63B 21/24* (2006.01)
*B63B 21/30* (2006.01)

(52) U.S. Cl.
CPC ..... *B63B 21/243* (2013.01); *B63B 21/30* (2013.01)

(58) Field of Classification Search
CPC ..... B63B 21/24; B63B 21/243; B63B 21/26; B63B 21/30
USPC ..... 248/156, 530, 533, 499; 52/157, 165; 114/294, 295; 405/241, 252.1
See application file for complete search history.

(56) References Cited

U.S. PATENT DOCUMENTS 3,283,893 A * 11/1966 Durocher ..... B65D 71/02 206/443
4,310,090 A * 1/1982 Mackarvich ..... B65D 85/62 206/343
4,702,047 A * 10/1987 Stokes ..... E02D 5/801 52/156
6,615,554 B2 * 9/2003 Rupiper ..... E02D 5/801 405/252.1
D575,719 S 8/2008 Goodwin
7,870,829 B1 1/2011 Perry et al.
8,312,832 B1 * 11/2012 Camp ..... B63B 21/26 114/295
8,667,919 B2 * 3/2014 Higby ..... B63B 21/00 114/293
10,144,489 B2 12/2018 Harrod
2005/0074298 A1 * 4/2005 Jones ..... E02D 5/523 405/252.1
2009/0277368 A1 11/2009 Bulloch
2010/0123067 A1 * 5/2010 Cardenas ..... F41B 5/1453 248/530
2012/0125247 A1 5/2012 Sheridan
2014/0007487 A1 1/2014 Schwiebert
(Continued)

FOREIGN PATENT DOCUMENTS

DE 202018001591 U1 * 6/2018
WO WO 88/08266 A1 * 11/1988

*Primary Examiner* — Sunil Singh
(74) *Attorney, Agent, or Firm* — Thompson Hine LLP

(57) ABSTRACT

A collapsible anchor for lightweight watercraft includes a handle member, including a left grip and a right grip, wherein the left grip and right grip are located across a central member from each other; a first tube member, the first tube member attached to the handle member and extending downward in a vertical orientation from the handle member; a second tube member, the second tube member removably attached to the first tube member and extending downward in a vertical orientation from the first tube member; and an auger member, the auger member attached to the second tube member and extending downward in a vertical orientation from the second tube member.

13 Claims, 4 Drawing Sheets

(56) References Cited

U.S. PATENT DOCUMENTS

| | | | | |
|---|---|---|---|---|
| 2014/0196955 | A1* | 7/2014 | Queen | E21B 7/005 175/57 |
| 2016/0215470 | A1* | 7/2016 | Reusing | E02D 5/56 |
| 2016/0244129 | A1 | 8/2016 | Cromartie | |
| 2018/0030681 | A1* | 2/2018 | Stroyer | E02D 5/801 |

* cited by examiner

SPORT ANCHOR

FIELD OF THE INVENTION

The present invention relates broadly to watercraft anchors, and more specifically to lightweight, easily-stowed anchors.

BACKGROUND OF THE INVENTION

Personal watercraft have become enormously popular over the past 50 years. Jet skis, kayaks, and small boats are a common sight wherever there are bodies of water accessible to large numbers of people. Because of the small size of such vessels, a large, heavy anchor is not practical. Often, small watercraft are anchored close to shore in shallow water, and a lightweight anchor that can dig into sand is a perfect solution to secure the watercraft. However, such anchors are still long, bulky, or inconvenient to use and store. Thus, there is a heartfelt need for an improved anchor for light or personal watercraft.

SUMMARY OF THE INVENTION

The present invention solves the problems above and provides a stowable, easily-assembled anchor that augers into sand or mud located under shallow water to safely secure a lightweight watercraft.

In one aspect, the present invention provides a collapsible anchor for lightweight watercraft includes a handle member, including a left grip and a right grip, wherein the left grip and right grip are located across a central member from each other; a first tube member, the first tube member attached to the handle member and extending downward in a vertical orientation from the handle member; a second tube member, the second tube member removably attached to the first tube member and extending downward in a vertical orientation from the first tube member; and an auger member, the auger member attached to the second tube member and extending downward in a vertical orientation from the second tube member.

In an embodiment, the first tube member includes an aperture configured to receive a flexible securing tab.

In an embodiment, the second tube member includes a flexible securing tab configured to insert into the aperture on the first tube member.

In an embodiment, the handle member includes an aperture.

In an embodiment, the first tube member includes a flexible securing tab configured to insert into the aperture of the handle member.

In an embodiment, the second tube member includes an aperture.

In an embodiment, the auger member includes a flexible securing tab configured to insert into the aperture on the second tube member.

In an embodiment, the first tube member includes a first plurality of protrusions along the length of the first tube member, and the second tube member includes a second plurality of protrusions along the length of the second tube member, wherein the first plurality of protrusions along the length of the first tube member connect to the second plurality of protrusions along the length of the second tube member and retain the first tube member in a parallel relationship with the second tube member.

In an embodiment, the first tube member attaches to the second tube member in a hinged relationship.

In an embodiment, the second tube member is insertable into the first tube member at a desired length.

In an embodiment, the handle member is attached to a first end of a retaining cord, the retaining cord having a length that extends through the first tube member and second tube member and connects at a second end to the auger member.

In an embodiment, the handle member includes a securing member configured to receive and secure a rope tied to a watercraft.

DETAILED DESCRIPTION OF THE INVENTION

Figure 1:
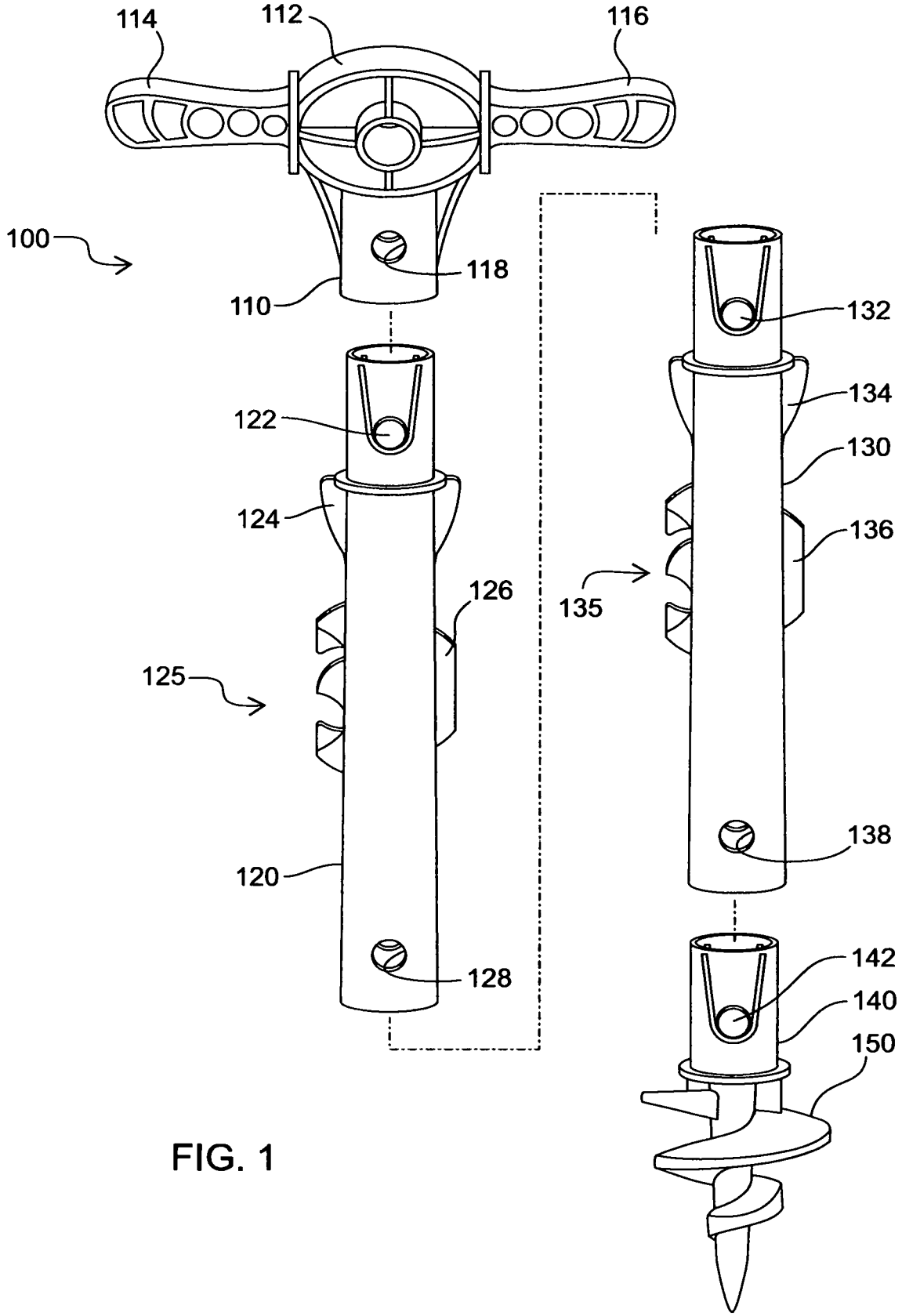
FIG. 1 shows an exploded view of a first embodiment of the sport anchor of the present invention.

Directing attention generally to the drawings, there is shown sport anchor 100 having multiple segments that assemble to form a shallow water anchor for personal watercraft. Sport anchor 100 includes handle member 110, first tube section 120, second tube section 130, and auger section 140. As shown, handle member 110 includes grip member 112 having left grip 114 and right grip 116, and attaches to first tube section 120 by a first aperture 118 configured to receive and retain a first flexible securing tab 122.

First tube section 120 includes flexible securing tab 122 that snaps into aperture 118. A plurality of longitudinal fins or protrusions 124, 125, and 126, which serve to secure a line in a vertical location along the length of first tube section 120. Protrusions 125 can be matched to similar protrusions on second tube section 130 (protrusions 135) in a snap fit to secure first tube section 120 to second tube section 130 in a rigid manner for storage. First tube section 120 includes a second aperture 128 configured to receive and retain a flexible securing tab 132 to releasably attach the second tube section 130.

Second tube section 130 includes flexible securing tab 132 that snaps into aperture 128. A plurality of longitudinal fins or protrusions 134, 135, and 136 can be provided, which serve to secure a line in a vertical location along the length of second tube section 130. Protrusions 135 can be matched to similar protrusions on first tube section 120 (protrusions 125) in a snap fit to secure second tube section 130 to first tube section 120 in a rigid manner for storage. Second tube section 130 includes aperture 138 configured to receive and retain a second flexible securing tab 142.

Auger section 140 includes flexible securing tab 142 that snaps into aperture 138 to secure auger section 140 to second tube section 130, or, if a shorter anchor length is desired, directly to first tube section 120 by snapping into aperture 128. Auger section 140 terminates with auger member 150.

Figure 2:
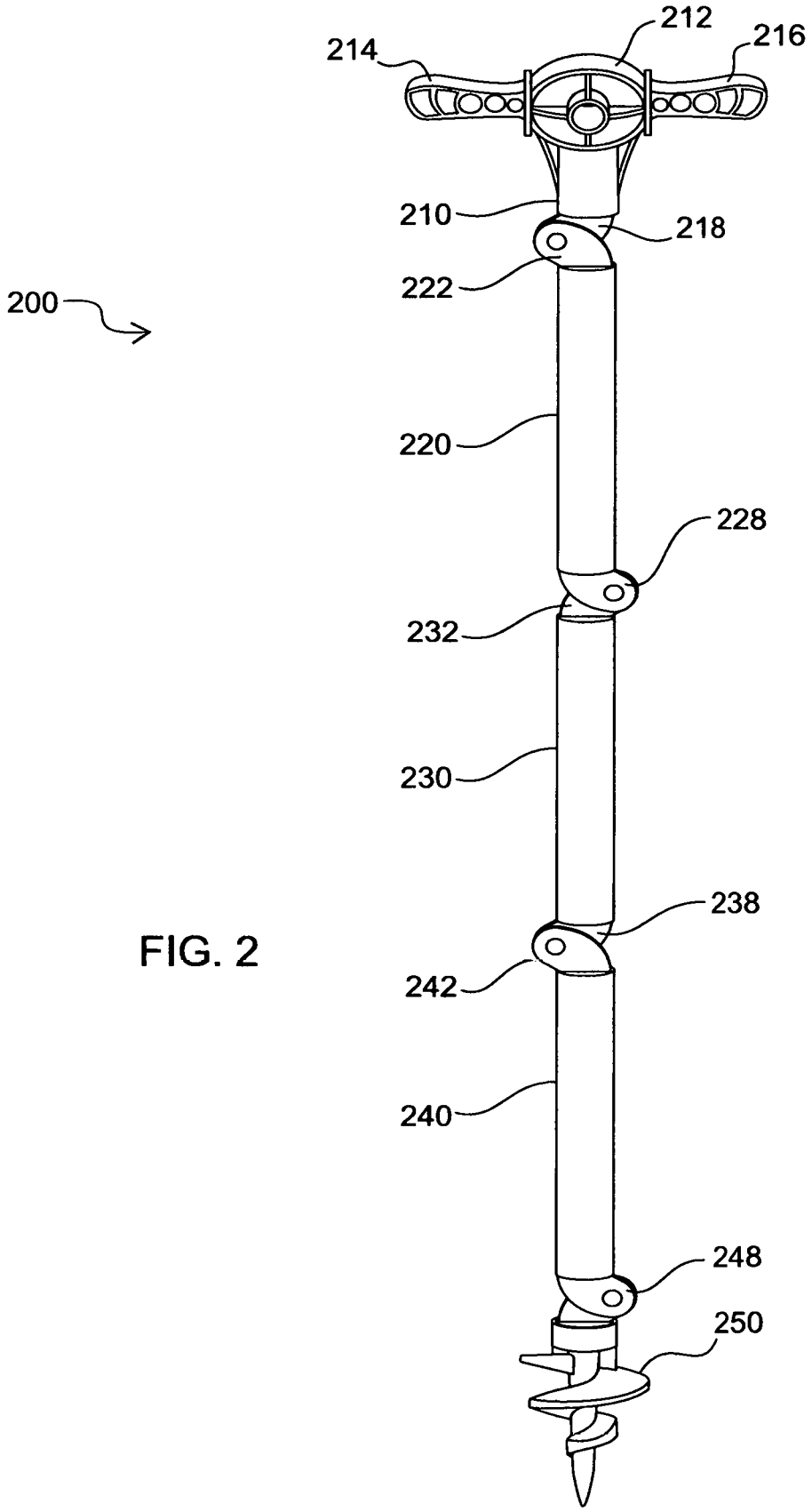
FIG. 2 shows a hinged version of the sport anchor of the present invention.

FIG. 2 shows an alternative embodiment sport anchor 200. Sport anchor 200 is a folding version of sport anchor 100 and uses hinges instead of apertures and securing tabs. Sport anchor 200 has multiple segments that assemble to form a shallow water anchor for personal watercraft. Sport anchor 200 includes handle member 210, first tube section 220, second tube section 230, third tube section 240, and auger section 250. As shown, handle member 210 includes grip member 212 having left grip 214 and right grip 216 and attaches to first tube section 220 by hinge member 218 configured to attach to another tube section's hinge member and rotate about an axis shared with the other hinge member.

First tube section 220 includes hinge member 222 that interfaces with hinge member 218. At the bottom of first tube section 220 is hinge member 228 configured to receive and rotate about an about an axis shared with the other hinge member.

Second tube section 230 includes hinge member 232 that interfaces with hinge member 228. At the bottom of second tube section 230 is hinge member 238 configured to receive and rotate about an about an axis shared with the other hinge member.

Third tube section 240 includes hinge member 242 that interfaces with hinge member 238. At the bottom of third tube section 240 is hinge member 248 configured to receive and rotate about an about an axis shared with the other hinge member.

Auger member 250 includes an auger at its bottom end, and a hinge member at its top end that interfaces with hinge member 248.

Figure 3:
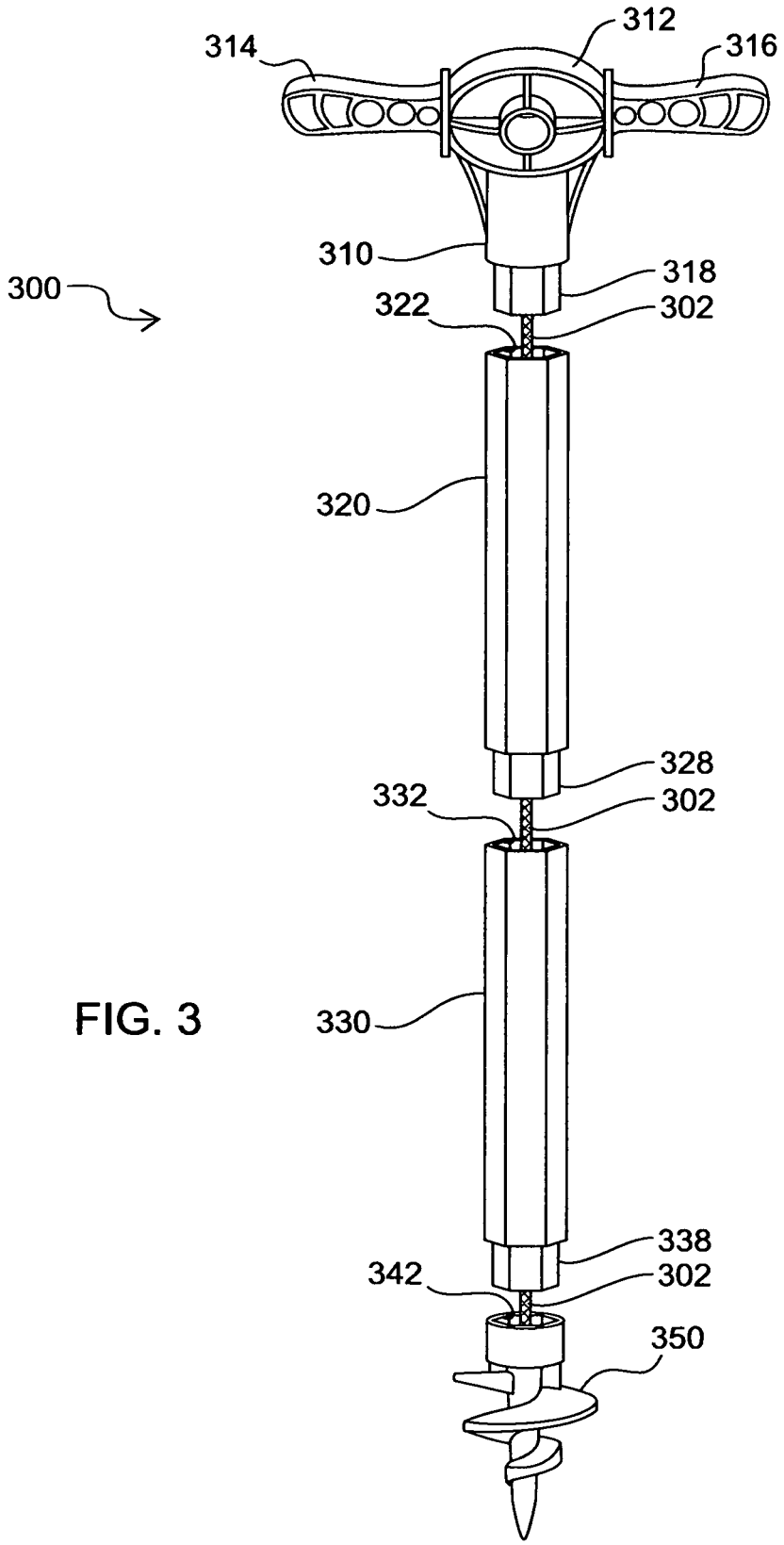
FIG. 3 shows a retaining cord placed through an alternative embodiment of the sport anchor of the present invention.

FIG. 3 shows yet another alternative embodiment of sport anchor 200. As shown, sport anchor 300 includes a retaining cord 302 that connects at one end to handle member 310 and extends through the center of first tube member 320 and second tube member 330 and attaches to auger member 350.

Sport anchor 300 includes handle member 310, first tube section 320, second tube section 330, and auger section 350. As shown, handle member 310 includes grip member 312 having left grip 314 and right grip 316 and attaches to first tube section 320 by inserting faceted insert member 318 into faceted aperture 322 at the top end of first tube section 320.

First tube section 320 includes faceted insert member 328 and attaches to second tube section 330 by placing faceted insert member 328 into faceted aperture 332 at the top end of second tube member 330.

Second tube member 330 includes faceted insert member 338 that, when inserted into faceted aperture 342 attaches second tube member 330 to auger member 350.

Figure 4:
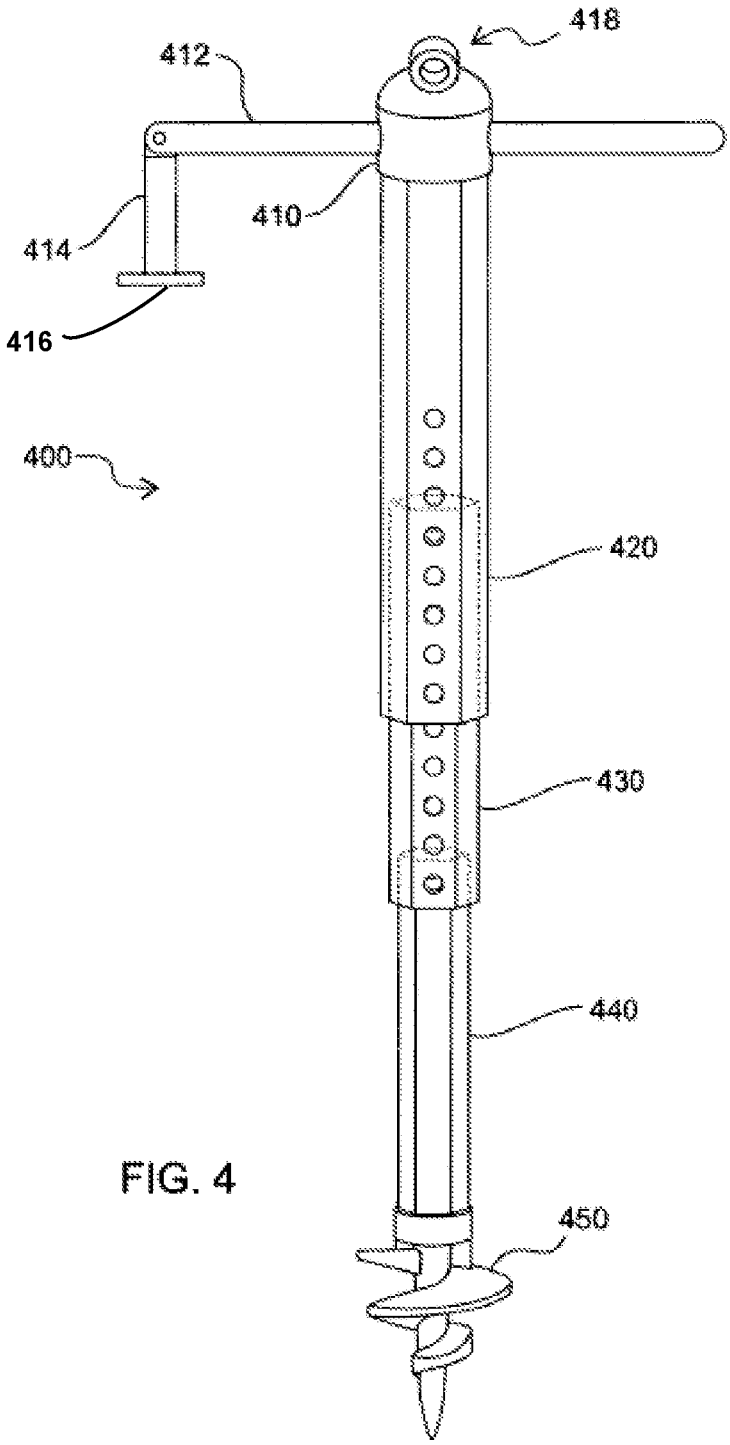
FIG. 4 shows a telescoping version of the sport anchor of the present invention.

FIG. 4 shows yet another alternative embodiment sport anchor 200. Sport anchor 400 is a telescoping version of sport anchor 100 and uses telescoping members with a series of apertures and a clickout tab that secures the telescoping members at desired positions thus forming a desired overall length for sport anchor 400. Sport anchor 400 includes handle member 410, first tube section 420, second tube section 430, third tube section 440, and auger section 450. As shown, handle member 410 includes grip member 412 insertable through handle member 410. Grip member 412 includes a hinged handle member 414 at one end of grip member 412. Handle member 414 includes terminal plate member 416 at the end of handle member 414. Handle member 410 may include securing member 418, to which a watercraft may be secured to anchor 400 by a rope. Handle member 410 is attached to first tube member 420. As shown, first tube member 420 includes a plurality of apertures that receive a securing tab integral to second tube member 430. The securing tab, when inserted into one of the apertures on first tube member 420, retains second tube member 430 within first tube member 420 at a desired length. Second tube member 430 is dimensioned smaller than first tube member 420, and also includes a plurality of apertures to receive and retain a clickout tab on third tube member 440.

Third tube member 440 likewise is smaller in dimension than second tube member 430, and includes a clickout tab that, when placed into one of the apertures along second tube member's length, secures third tube member 440 within second tube member 430 at a desired length.

The profile for first tube member 420, second tube member 430, and third tube member 440 are shown to be hexagonal. This is to prevent a smaller tube member from twisting within its larger, host tube member. While the profile is shown to be hexagonal, any faceted profile is sufficient, such as square, triangular, hexagonal, etc. As long as the tube member has a faceted profile rather than round, one member is not able to rotate within or around another member.

Materials used to construct sport anchor 100, 200, 300 and 400 can be lightweight plastic so that the anchor floats to the surface of a body of water if it becomes dislodged from the sand or mud under the water. However, numerous other materials can be used, such as fiberglass, metal, carbon fiber, or other sufficiently strong material. The pieces also can be brightly colored or white for high visibility.

While the preferred embodiments of the sport anchor of the present invention have been described and illustrated in detail, it is to be understood that numerous modifications can be made to the various embodiments of the present invention without departing from the spirit thereof.

What is claimed is:

1. An anchor system comprising:

a first member;

a second member configured to be releasably coupled to the first member;

a handle member configured to be releasably coupled to the first member; and an auger member configured to be releasably directly or indirectly coupled to the first member, wherein one of the first or second members has at least one of a fin or protrusion on an outer surface thereof, and wherein the other one of the first or second members has a plurality of fins or protrusions on an outer surface thereof, and wherein the at least one fin or protrusion on the at least one of the first or second members is configured to be coupled to the plurality of fins or protrusions of the other one of the first or second members to thereby releasably couple the first and second members together in the lateral direction.

2. The system of claim 1 wherein the first member has first and second opposed ends, and wherein the first end of the first member is configured to be releasably directly coupled to the handle member and the second end of the first member is configured to be releasably directly coupled to the second member, wherein the second member has first and second opposed ends, wherein the first end of the second member is configured to be releasably directly coupled to the first member and the second end of the second member is configured to be releasably directly coupled to the auger member.

3. The system of claim 1 wherein the first member and the second member are both hollow tube members.

4. The system of claim 1 wherein when the second member is releasably coupleable to the first member in the lateral direction in a configuration where the first and second members are generally parallel and arranged in a side-by-side configuration.

5. The system of claim 1 wherein the first member and the second member are substantially identical.

6. The system of claim 1 wherein the handle member, the first member and the auger member are configured, when fully assembled, to form an anchor having a central axis such that the first member is aligned along the axis, wherein the handle member is oriented generally transverse to the axis, and wherein the anchor is configured such that, when the anchor is rotated about the central axis as driven by the handle, the auger is configured to drive into an underlying sand or mud surface.

7. The system of claim 1 wherein the handle member and the first member are configured to be releasably directly coupled together by a securing structure, and wherein the auger member and the first member are configured to be directly releasably coupled together by the same nature of securing structure.

8. The system of claim 1 wherein:

the handle includes a first aperture, wherein the first member includes a first tab, and wherein the first aperture is configured to removably receive the first tab therein to releasably couple the handle member and the first member; and wherein the first member includes a second aperture, wherein the auger includes a second tab, and wherein the second aperture is configured to releasably receive the second tab therein to releasably couple the first member and the auger.

9. The system of claim 1 wherein the handle member is a generally longitudinally extending body having opposed left and right grips positioned on opposite sides of the first member when the handle member is coupled to the first member.

10. The system of claim 1 wherein the first member is configured to be directly coupled to the handle member and to the auger member.

11. The system of claim 1 wherein the handle member and the first member each have a faceted portion configured to engage each other to prevent rotation of the first member relative to the handle, and wherein the first member and the auger member each have a faceted portion configured to engage each other to prevent rotation of the auger relative to the first member.

12. The system of claim 1 further comprising a retainer cord coupled to the handle and to the auger, wherein the retainer cord extends through the first member.

13. The system of claim 1 wherein the handle member, the first member, the second member and the auger member are configured, when fully assembled, to form an anchor having a central axis such that the first and second members are aligned along the axis, wherein the handle member is oriented generally transverse to the axis, wherein the anchor is configured such that, when the anchor is rotated about the central axis as driven by the handle, the auger is configured to drive into an underlying sand or mud surface, wherein the handle member and the first member are configured to be releasably directly coupled together by a securing structure, wherein the first member and the second member are configured to be directly releasably coupled together by the same nature of securing structure, and wherein the auger member and the second member are configured to be directly releasably coupled together by the same nature of securing structure.

* * * * *